US006321876B1

(12) United States Patent
Kawai et al.

(10) Patent No.: US 6,321,876 B1
(45) Date of Patent: Nov. 27, 2001

(54) CONTROL OPERATION SYSTEM FOR ELEVATOR WITH FLOOD SPEED DETECTOR AND CONTROLLER

(75) Inventors: Kiyoji Kawai; Akihisa Miyajima, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/615,321

(22) Filed: Jul. 13, 2000

Related U.S. Application Data

(63) Continuation of application No. PCT/JP98/05630, filed on Dec. 14, 1998.

(51) Int. Cl.[7] ..... B66B 1/34
(52) U.S. Cl. ..... 187/391
(58) Field of Search ..... 187/391, 390, 187/393, 414, 247

(56) References Cited

U.S. PATENT DOCUMENTS 3,819,066 * 6/1974 Jones ..... 187/68
4,995,477 * 2/1991 Perricone ..... 187/1 R
6,000,505 * 12/1999 Allen ..... 187/391

FOREIGN PATENT DOCUMENTS 53-36274 3/1978 (JP) .
60-213673 10/1985 (JP) .
2-132081 11/1990 (JP) .
406171857-A * 6/1994 (JP) .
6166481-A * 6/1994 (JP) .
9012249-A * 1/1997 (JP) .
11147678-A * 6/1999 (JP) .
2000191250-A * 7/2000 (JP) .

* cited by examiner

*Primary Examiner*—Jonathan Salata
(74) *Attorney, Agent, or Firm*—Leydig, Voit & Mayer, Ltd.

(57) ABSTRACT

A control operation system for an elevator includes a flood detector for detecting a flood amount in a hoistway in an elevator, a flood speed computer for computing flood speed based on the detected flood amount, and a flood control operation command for flood control operation of the elevator based on the flood speed, making it possible to provide a flood control operation best suited to a flood speed.

13 Claims, 12 Drawing Sheets

CONTROL OPERATION SYSTEM FOR ELEVATOR WITH FLOOD SPEED DETECTOR AND CONTROLLER

REFERENCE TO RELATED APPLICATION

This application is a continuation of International Application No. PCT/JP98/05630, whose international filing date is Dec. 14, 1998, the disclosure of which Application is incorporated by reference herein. The benefit of filing and priority dates of the International Application is are claimed.

TECHNICAL FIELD

The present invention relates to a control operation system for an elevator that detects a flood in a pit of an elevator, performs operation control to cope with the flood, and provides display and information regarding the flood.

BACKGROUND ART

There techniques many conventional arts for detecting a flood and performing control operation of an elevator. Some of them are disclosed in, for example, Japanese Unexamined Patent Publication No. 53-36274, Japanese Unexamined Patent Publication No. 60-213673, and Japanese Unexamined Patent Publication No. 62-89269, all of which disclose arts wherein a flood is detected and an evacuation operation or a suspension of elevator is operation. In all these techniques, however, floods are detected in the same manner, so that no operation based on flood speed is performed.

A flood detector is provided, and if the flood detector is actuated, then the elevator travels to a floor free of a danger of a flood, and services of car calls or hall calls are prohibited thereafter. The operation of the elevator is suspended at the evacuation floor. In addition, the occurrence of the flood is displayed and reported in a car, at halls, a manager's room, etc.

The conventional elevator control operation system is configured as described above, and therefore cannot perform an operation based on a flood speed, e.g., sudden flooding or slow flooding. Hence, in case of a sudden flood, which should require a sudden stop of the elevator, the same evacuation operation, posing a problem in that important equipment for safety of the elevator is flooded while the elevator is running, leading to a failure of assuring passengers in a car of safety. There has been another problem in that, in case of slow flooding that should not require a evacuation operation, the same evacuation operation is performed, so that subsequent elevator operation is interrupted and the elevator as a vertical transportation in a building is paralyzed, causing inconvenience to users of the elevator.

Hitherto, as disclosed in Japanese Unexamined Patent Publication No. 4-209180, there has been proposed an elevator control operation system that issues an alarm upon detection of water leakage into a car.

A water leakage detector is provided on the car, and an alarm means that issues an alarm in response to a signal of the detector and a means for controlling the operation of the elevator are provided.

Since the conventional elevator control operation systems are constructed as set forth above, they have been able to detect only presence of a flood. Hence, there has been a problem in that an elevator is already unusable by the time an alarm is issued.

There has been another problem in that users suddenly find that an elevator is unavailable, and progress of recovery from a flooded state is unclear, causing inconvenience to passengers.

DISCLOSURE OF INVENTION

The present invention has been made with a view toward solving the problems described above, and it is an object of the invention to provide a control operation system for an elevator that measures flood speed and provides a flood control operation best suited for the flood speed. It is another object of the invention to provide a control operation system for an elevator that performs a backup flood control operation to provide against an emergency.

It is a further object of the invention to provide a control operation system for an elevator that comprehends a flood state, and displays and reports it to inform a manager or the like of an increase or decrease in flood water so as to permit an action appropriate for the flood state to be taken, and also to provide passengers with a prior notice regarding predicted recovery of the elevator following the flood, thus achieving a more friendly elevator.

A control operation system for an elevator in accordance with the present invention includes a flood detector for detecting a flood amount in a hoistway of an elevator; flood speed computing means for determining a flood speed based on a detection value of the flood detector; and flood control operation command means for setting an elevator flood control operation mode based on the flood speed computed by the flood speed computing means and issuing a command to t e elevator. This arrangement makes it possible to detect and compute an increase in a water level in the hoistway in terms of flood speed, enabling a flood control operation to be carried out at an optimum timing. In other words, it is possible to implement a control operation method in which, for example, an elevator is brought to an emergency stop if a water level suddenly rises, while the elevator transports passengers to a target floor without confining the passengers in a car, then travels to a evacuation floor if the water level slowly rises, rather than starting the same control operation.

The elevator control operation system is further provided with flood predicting means for predicting a future development of a flood based on at least one of a flood amount detected by the flood detector and a flood speed computed by the flood speed computing means, wherein the flood control operation command means sets a flood control operation method according to a predicting result of the flood predicting means. With this arrangement, predicting, for example, a timing at which an operation should be stopped makes it easier to determine an operation method of the elevator until that moment, thus making it possible to perform a flood control operation at a better timing by a most suited method.

The elevator control operation system is further provided with: display information generating means for editing at least one of the flood amount detected by the flood detector, the flood speed computed by the flood speed computing means, and the future flood development predicted by the flood predicting means into a display format; and a flood display unit for displaying information edited and formed by the display information generating means. This arrangement allows a flood situation to be reported to a user or a manager of an elevator, thus alleviating insecurity of the user by informing the user of a reason for a flood control operation, which is different from a regular operation, and also enabling the manager to take a quick, appropriate action.

The flood display unit displays an estimated time for the flood amount to reach a predetermined water level from the moment a flood in the hoistway is detected. With this arrangement, a time at which the operation is stopped is displayed and reported by the flood display unit, making it possible to furnish a user or a manager with information that permits a future development to be predicted. Hence, the user can know a reason for a suspended use of the elevator, so that the user can understand the operation of the elevator that is different from the regular operation.

If a flood speed for a flood amount in a hoistway to reach a predetermined water level is a first predetermined speed or more, then the flood control operation command means immediately stops an elevator. With this arrangement, if, for example, a predetermined water level makes it difficult to continue operating the elevator and if the time for reaching that situation is shorter than a time required for the elevator to continue normal running until it reaches a nearest floor and stops there, then the elevator is immediately stopped. The elevator is stopped at least before the predetermined water level is reached, making it possible to prevent an operational abnormal situation from taking place.

If the flood speed for the flood amount in the hoistway to reach the predetermined water level is lower than the first predetermined speed but a second predetermined speed or more, then the flood control operation command means causes the elevator to stop at a nearest floor. With this arrangement, if, for example, a predetermined water level makes it difficult to continue operating the elevator and if the time for reaching that situation is longer than a time required for the elevator to continue normal running until it reaches a nearest floor and stops there, but is too short for continuing an operation for a plurality of floors, then the elevator is operated until it reaches a nearest floor and placed at a rest. This makes it possible to let passengers of the elevator get off at the nearest floor rather than confining them in a car by a sudden stop. Thereafter, it is also possible to operate the elevator to a evacuation floor without any passengers, as necessary, if the second predetermined time has not been reached.

If the flood speed for the flood amount in the hoistway to reach the predetermined water level is slower than the second predetermined time, then the flood control operation command means prevents a new call from being assigned to the elevator, and causes the elevator to stop at a nearest evacuation floor after responding to at least one call that has already been assigned. With this arrangement, if, for example, a predetermined water level makes it difficult to continue the operation of the elevator and if there is a sufficient allowance time before reaching the water level, then the car is landed to a nearest evacuation floor after responding to at least a call that has been assigned by that point. Thus, the elevator is able to accomplish an already expected service before it is stopped, permitting the stop to be made without causing users to feel uncomfortable. Incidentally, a new call may be assigned to another car number. Even if there is the only one elevator that could respond to the new call, it would merely happen that the new call would not be able to be registered, and the call that has already been accepted will be responded within the allowance time.

If the flood detector detects a flood, then no response will be allowed to a predetermined floor in the vicinity of a terminal. Since a flood water in the hoistway normally accumulates in a pit at a bottom, when a car stops at a lowest floor or if the car is at a highest floor, then a counterweight would be affected by the flood when it is positioned at the lowest floor. Hence, the foregoing arrangement is made to prevent the car from being allowed to landed at a predetermined floor in the vicinity of a terminal when a flood is detected, thereby protecting the car or the counterweight from being immersed in the water.

The elevator control operation system is further provided with an auxiliary flood detector for detecting at least a water level in a range that should be detected by the flood detector. If the flood detector is not actuated at a water level that should be detected by the flood detector, while the auxiliary detector is actuated, then the flood control operation command means causes the elevator to stop at a nearest evacuation floor. If the flood detector fails to detect the flood, while the auxiliary flood detector detects the same flood, then there is a possibility that the flood detector 1 has incurred a failure. In such a case, there is a danger in that a water level has actually risen, requiring the elevator be quickly moved to a safe place. Thus, by running the car to a nearest evacuation floor and stopping it there, the elevator can be protected from damage attributable to a failure of the detector.

Furthermore, if a flood amount in the hoistway reduces without reaching a predetermined water level, then the flood predicting means estimates a time required for reaching a water level that permits an operation to be resumed, and the flood display unit displays the estimated recovery time. This arrangement makes it possible to furnish a user or a manager with information that enables them to predict a future development. Thus, since the user can obtain predictive information regarding the recovery, he or she does not have to feel frustrated.

When the flood amount in the hoistway reaches the water level that enables the operation to be resumed, the flood control operation command means clears a flood control operation mode and restores a normal operation mode. With this arrangement, if a flood stops without reaching a level at which the elevator is required to be stopped and reduces thereafter, the elevator will not incur damage even if the operation is resumed. If the time required for the operation to be resumed can be estimated, then preparations are made in advance so that the flood control operation mode is cleared based on the time. When an appropriate water level is reached, the flood control operation mode is cleared to thereby resume the operation at an appropriate timing without the need of waiting for maintenance staff, permitting a quick recovery with consequent improved service.

Furthermore, once the flood amount in the hoistway has reached a predetermined water level, the flood control operation is continued even when the water level decreases. If a flood has reached a level at which the elevator is required to be stopped, there is a possibility of the elevator having incurred some damage and therefore abnormal conditions may occur when the operation is automatically restarted, even if the water level of a flood decreases. Hence, the operation should not be resumed. With the arrangement described above, the flood control operation is continued, and the operation is resumed after, for example, an inspection by maintenance personnel is performed, so that improved safety can be achieved.

In addition, the elevator control operation system is further provided with a reset switch. When the flood control operation is being continued, the reset switch is operated to clear a command for the flood control operation.

With this arrangement, when an inspection is performed by maintenance staff and it is decided from an inspection result that there should be no problem with resuming the operation, the operation can be resumed simply by operating the reset switch.

BEST MODE FOR CARRYING OUT THE INVENTION

The following will describe embodiments in accordance with the present invention.

First Embodiment

Figure 1:
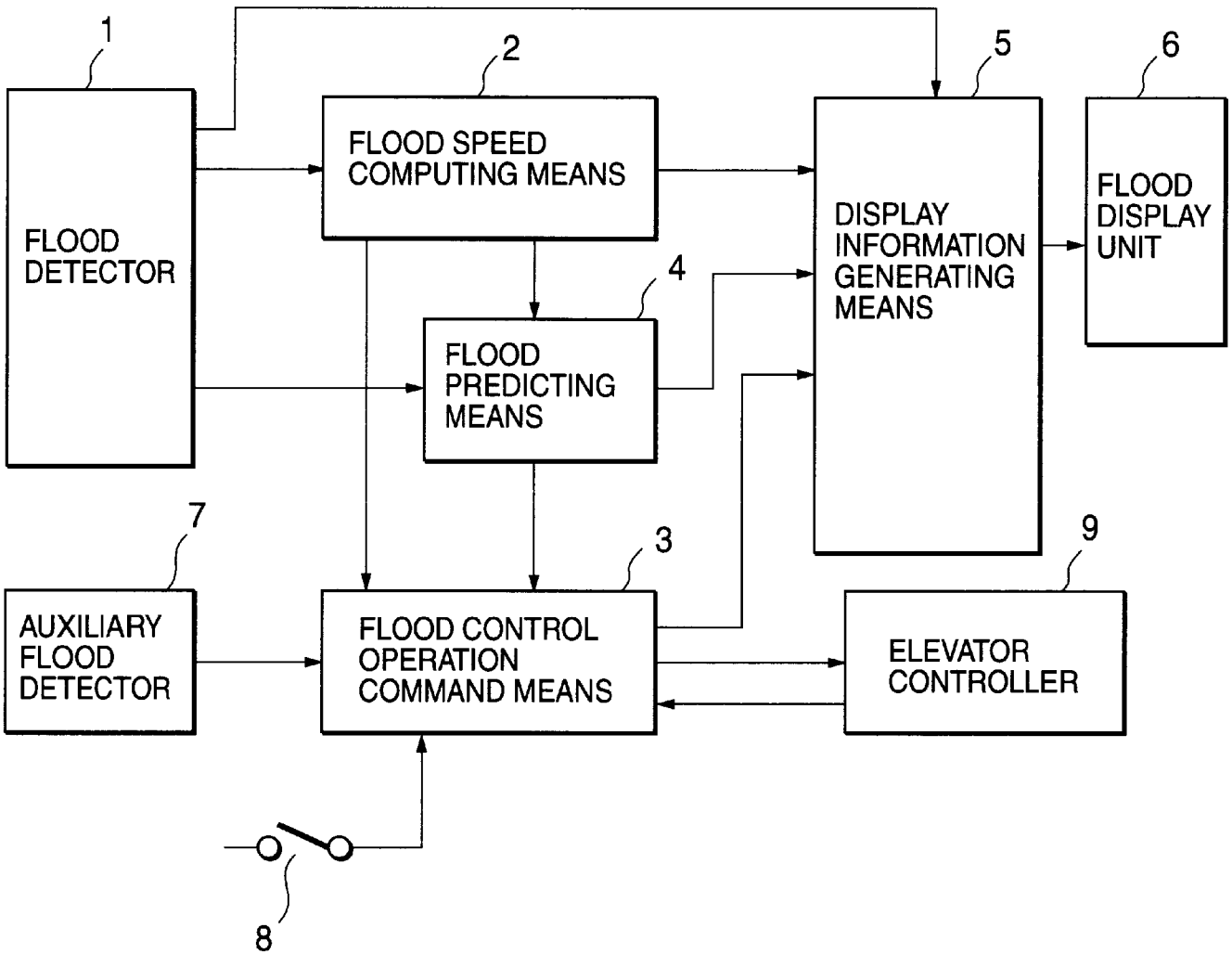
FIG. 1 is a block diagram showing a control operation system for an elevator according to a first embodiment of the present invention.

FIG. 1 is a block diagram showing a control operation system for an elevator in accordance with a first embodiment of the present invention.

In FIG. 1, reference numeral 1 denotes a flood detector, which detects an entering substance composed primarily of a liquid, such as water that enters a pit in a hoistway, and normally detects water levels (flood amount) of at least two or more levels in succession. There are diverse detection methods, including a method wherein a plurality of water level detecting elements are disposed according to a depth, and a method wherein a communicating tube is vertically set, ultrasonic waves are applied to a water level from an upper end of the communicating tube, and the reflection signal is measured.

Reference numeral 2 denotes a flood speed computing means for determining a variation of a flood based on a detection value of the flood detector 1. Reference numeral 3 denotes a flood control operation command means for instructing the elevator to implement an elevator control operation method or one method selected among a plurality of methods, based on a flood speed computed by the flood speed computing means 2.

Reference numeral 4 denotes a flood predicting means for predicting a future development of a flood, based on at least one of a flood amount detected by the flood detector 1 and a flood speed computed by the flood speed computing means 2.

Reference numeral 5 denotes a display information generating means for editing at least one of the flood amount detected by the flood detector 1, the flood speed computed by the flood speed computing means 2, and the future flood state predicted by the flood predicting means 4, into a display format. Reference numeral 6 denotes a flood display unit for displaying a flood state of an elevator. The flood display units displays information edited and formed by the display information generating means 5.

Reference numeral 7 denotes an auxiliary flood detector for detecting that a flood in the pit in the hoistway has reached a vicinity of a predetermined water level in the flood detector 1. The auxiliary flood detector can be achieved by providing, for example, a float type water level indicator because it is only required to measure at least one level of an absolute water level.

Reference numeral 8 denotes a reset switch used to restore a normal operation by pressing the switch once when maintenance staff inspects after a flood to decide if the elevator can be operated following a recovery.

Reference numeral 9 denotes an elevator controller.

Figure 2:
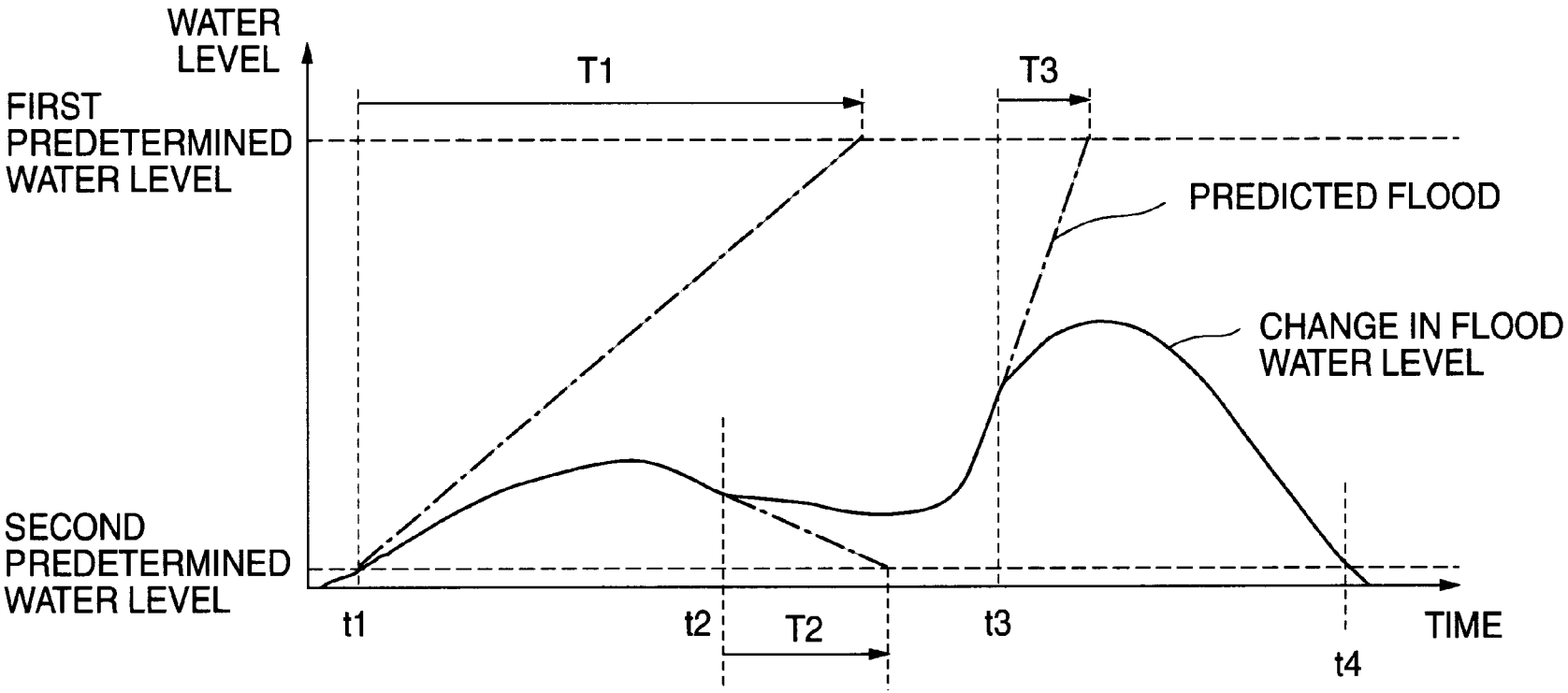
FIG. 2 is a time chart illustrating an operation of the control operation system for an elevator of FIG. 1 in a flood state.

An operation of the control operation system for an elevator according to the first embodiment of the present invention in a flood state will be described in conjunction with a time chart of FIG. 2.

An elevator in this example has a drain system (not shown) provided against a flood in a hoistway. A difference between entering water and draining water causes a change in an increase or decrease of the flood.

A flood begins in the hoistway and reaches at a second predetermined water level at time $t_1$. At this time, the water level is still rising, and $T_1$ indicates a computed time estimated for a first predetermined water level to be reached, the computed time being based on a flood speed at that point. By comparing the computed $T_1$ with a predetermined time, a control operation suited for a situation at that point is selected among a plurality of elevator control operation methods, and a command for implementing the selected method is issued.

Thereafter, the risen water level lowers once. $T_2$ indicates an estimated recovery time required for the operation of the elevator to be resumed, the estimated recovery time being obtained at time $t_2$. For instance, by displaying the estimated recovery time to inform of users of an estimated waiting time for a recovery, user complaints can be resolved.

After that, the water level rises again, the flood speed extremely increases at time $t_3$, and an estimated flood time shortens as indicated by $T_3$. Accordingly, a command for a control operation suited to a situation at that point is issued. However, the elevator at that point is at halt based on the control operation command previously issued and does not have to be operated. If, however, there is a car that is at a halt between floors because of the previous control operation command, then the car runs to a nearest floor when the estimated flood time has become distant, making it possible to rescue passengers, if any, confined in the car. Then, the water level starts to lower again, and at time $t_4$, it reaches the second predetermined water level at which the flood operation mode may be cleared, and the flood operation command is cancelled.

In the case of this example, since the water level does not reach the first predetermined water level, the normal operation can be resumed without waiting for maintenance personnel to press the reset switch. Based on the estimated times $T_1$, $T_2$, and $T_3$, a flood control operation method is selected and a display based on the information is provided on the flood display unit 6, permitting detailed services to be implemented.

Figure 3:
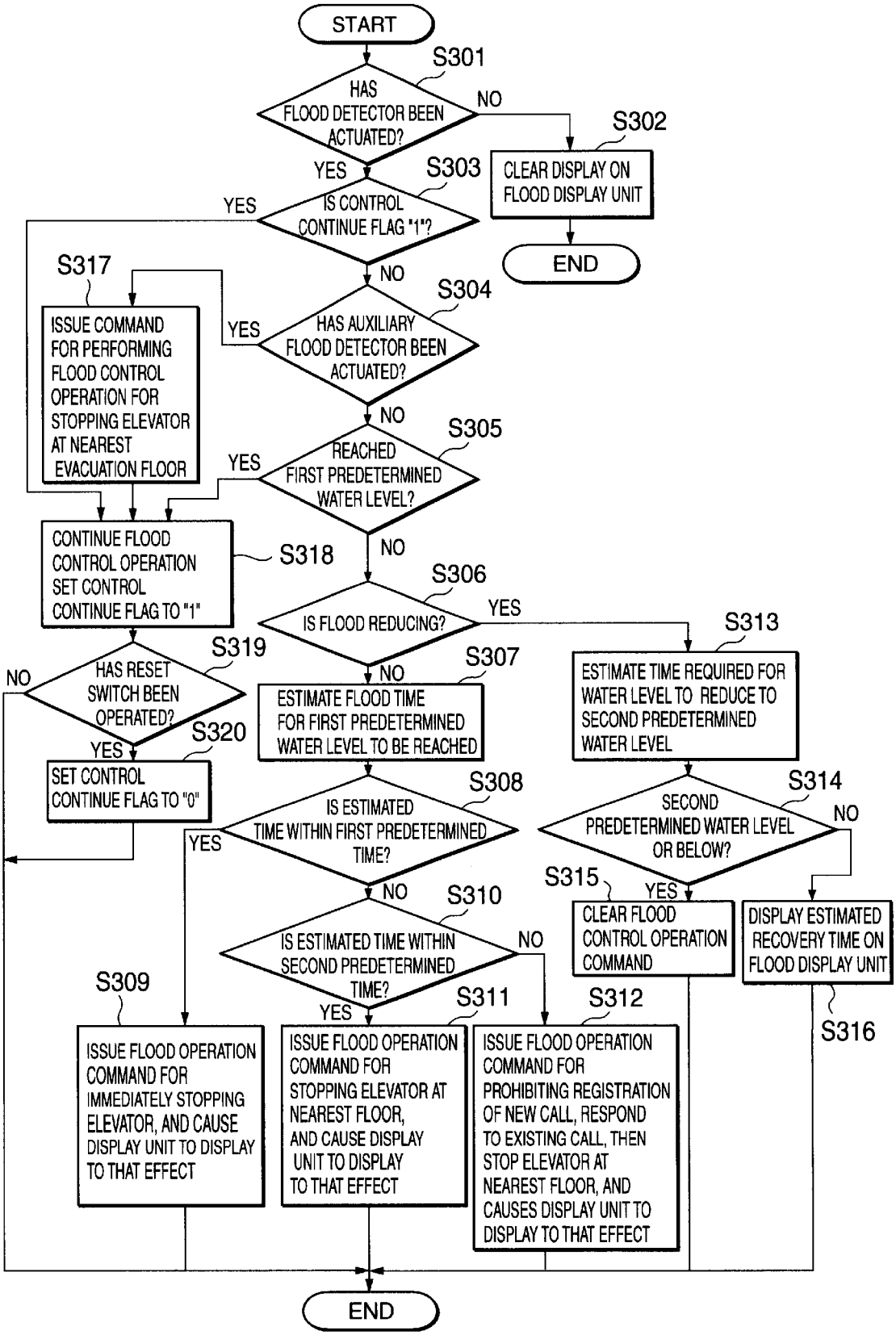
FIG. 3 is a flowchart illustrating the operation of the control operation system for an elevator of FIG. 1.

The operation of the elevator control operation system according to the first embodiment of the present invention will be further described in conjunction with a flowchart of FIG. 3.

First, if the flood detector 1 is found to be not operating in S301, then a display of the flood display unit 6 is cancelled in S302. If the flood detector 1 is found to be operating, then the system proceeds to S303 where it checks a control continuance flag. If the control continuance flag has not been set and the auxiliary flood detector 7 is not operating in S304, then the system proceeds to S305 where it checks whether or not the water level has reached the first predetermined water level. If the first predetermined water level has not been reached, then the system checks for an increase or decrease in a flood in S306. If the flood has increased, then a flood time for the first predetermined water level to be reached is estimated in S307 the system then proceeds to S308, and if the estimated time is within the first predetermined time, that is, if an estimated flood water increasing speed is a first predetermined speed or more, then the system issues, in S309, a flood operation command for immediately stopping the elevator and causes the flood display unit 6 to display to that effect.

In step S308, if the estimated time is found to exceed the first predetermined time, then the system proceeds to S310, and if the estimated time is within a second predetermined time, that is, if an estimated flood water increasing speed is the first predetermined speed or less and a second predetermined speed or more, then the system issues a flood operation command for stopping the elevator at a nearest floor and causes the flood display unit 6 to display to that effect. If the estimated time is the second predetermined time or more, that is, if the estimated flood water increasing speed is the second predetermined speed or less, then the system prohibits registration of a new call in S312, issues a flood operation command for responding to an existing call and stopping at a nearest floor, and causes the flood display unit 6 to display to that effect.

If the flood is found to be decreasing in S306, then the system estimates, in S313, a time for the water level to lower to the second predetermined water level, that is, a time for the elevator operation to be recovered. The system further proceeds to S314, and if it finds that the water level is the second predetermined water level or less, then it clears the elevator flood control operation command in S315. If the water level has not lowered to the second predetermined water level, then an estimated recovery time is displayed on the flood display unit 6.

If the control continuation flag is found to be set in S303, or if the auxiliary flood detector 7 is found to be operating in S304 and the flood control operation command for stopping the elevator at a nearest evacuation floor free of a danger of a flood is issued in S317, or if the water level is found to have reached the first predetermined water level in S305, then the system proceeds to S318 where it continues the flood control operation and sets the control continuation flag. Subsequently, operating the reset switch in S319 sets the control continuation flag OFF.

The same effect can be obtained by replacing "Has the flood detector been actuated" of S301 by "Has the second predetermined water level been exceeded?" depending on a situation. The latter one, in particular, contributes to convenience to users by continuing to provide normal service, because entry of water does not cause the flood control operation to be immediately started when a small flood does not develop into a problem.

Second Embodiment

Figure 4:
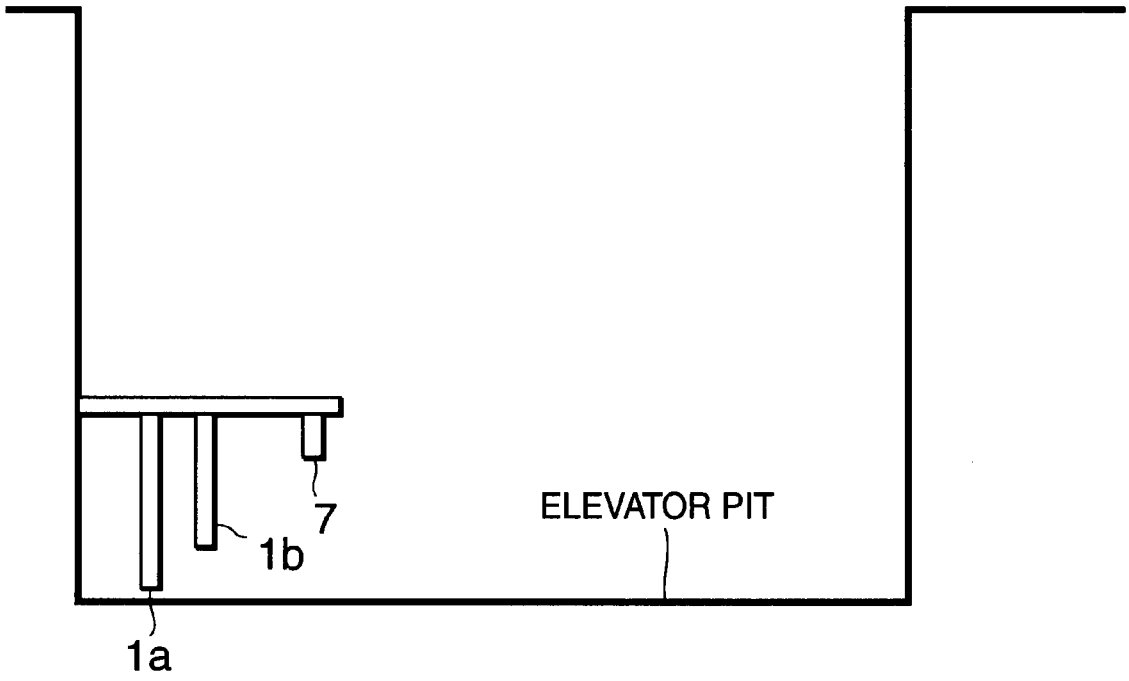
FIG. 4 is a diagram showing a flood detector of a control operation system for an elevator according to a second embodiment of the present invention, the flood detector having been installed in an elevator pit.
Figure 5:
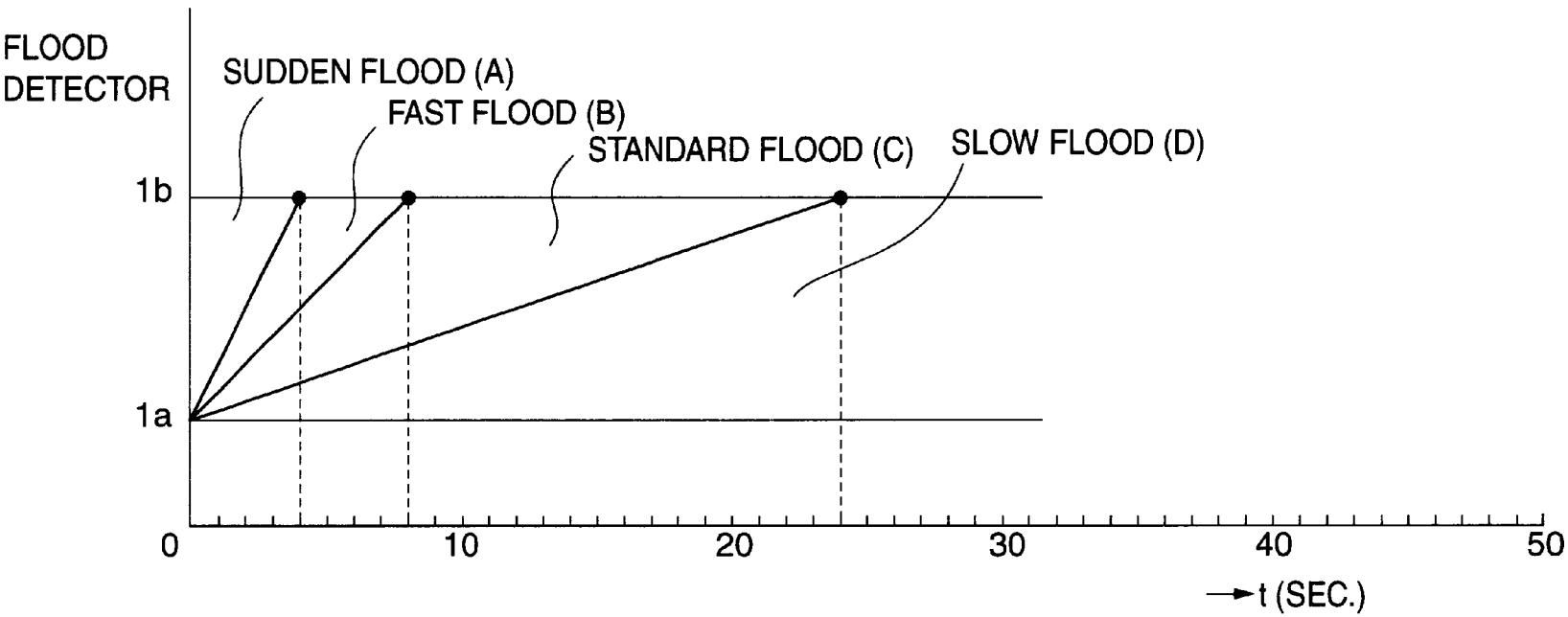
FIG. 5 is an explanatory diagram of flood speed.
Figure 6:
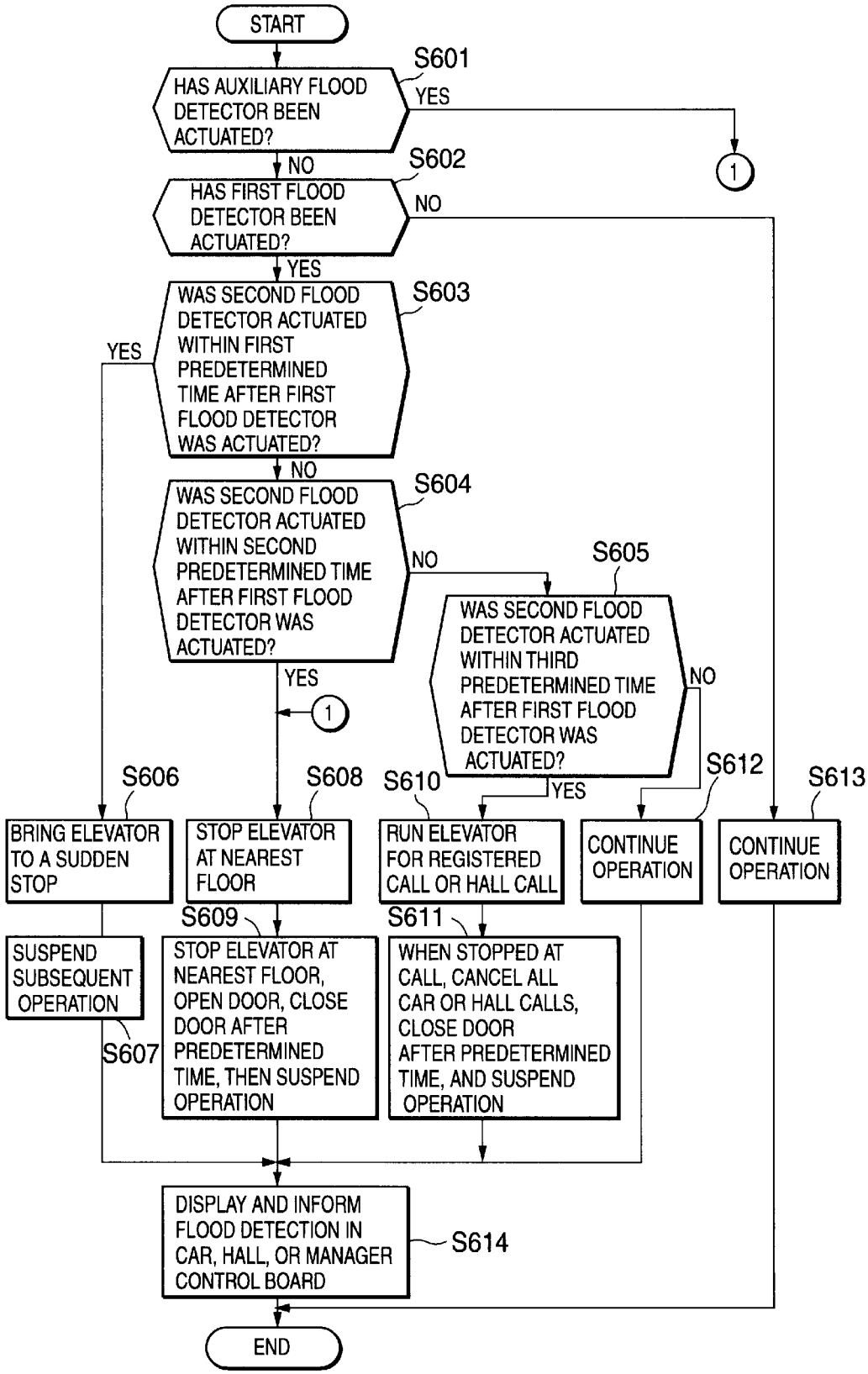
FIG. 6 is a flowchart illustrating the operation of the elevator control operation system according to the second embodiment of the present invention.

FIG. 4 is a diagram showing a flood detector installed in an elevator pit. FIG. 5 is an explanatory diagram of flood speed. FIG. 6 is a flowchart illustrating an operation of an elevator control operation system according to a second embodiment of the present invention.

A configuration of the elevator control operation system is basically the same as that shown in FIG. 1.

Detailed explanation will follow in conjunction with the accompanying drawings.

As shown in FIG. 4, the flood detector 1 is provided in a pit, and constituted by a first flood detector 1*a* installed so that it is able to detect a flood at a position in the vicinity of a pit bottom surface and a second flood detector 1*b* installed at a position higher than the first flood detector 1*a* from the pit bottom surface. The auxiliary flood detector 7 is installed at a position higher than the second flood detector 1*b* to detect a flood.

An operation of the elevator control operation system according to the second embodiment of the present invention in a flood state will be described in conjunction with FIG. 5.

The abscissa indicates time (unit in second), and the ordinate indicates operation of the flood detectors. A flood speed is detected during a period of time (interval) from the moment the first flood detector 1*a* is actuated to the moment the second flood detector 1*b* is actuated. If the period of time from the moment the first flood detector 1*a* is actuated to the moment the second flood detector 1*b* is actuated is within a first predetermined time (e.g. 4 seconds), then the flood speed is regarded as a sudden flood speed, a region denoted by A in the chart corresponding to the sudden flood speed. If the period of time from the moment the first flood detector 1*a* is actuated to the moment the second flood detector 1*b* is actuated is within a second predetermined time (e.g. 8 seconds), then the flood speed is regarded as a fast flood speed, a region denoted by B in the chart corresponding to the fast flood speed. Further, if the period of time from the moment the first flood detector 1*a* is actuated to the moment the second flood detector 1*b* is actuated is within a third predetermined time (e.g. 24 seconds), then the flood speed is regarded as a standard flood speed, a region denoted by C in the chart corresponding to the standard flood speed. And if the period of time from the moment the first flood detector 1*a* is actuated to the moment the second flood detector 1*b* is actuated exceeds the third predetermined time, then the flood speed is regarded as a slow flood speed, a region denoted by D in the chart corresponding to the slow flood speed.

An operation of the elevator control operation system according to the second embodiment of the present invention will be described in conjunction with a flowchart of FIG. 6.

In S601, considering safety, top priority is given to checking whether the auxiliary flood detector 7 has been actuated or not. If the auxiliary flood detector 7 has not been actuated, then the system proceeds to S602. In S602, the system detects whether the first flood detector 1*a* has been actuated or not, and if it has been actuated, then the system proceeds to S603. If the first flood detector 1*a* has not been actuated, then the system proceeds to S613 and continues normal operation. In S603, the system determines whether the second flood detector 1*b* was actuated within the first predetermined time (e.g. 4 seconds) after the first flood detector 1*a* was actuated, and if the determination result is affirmative, then the system decides that the sudden flood speed applies, and proceeds to S606 wherein the system brings the elevator to a sudden stop. In S607, any further operation is suspended. Thereafter, the system proceeds to S614 wherein the flood detection is displayed and reported at a car, a hall, or a personnel control board.

If the second flood detector 1*b* has not been actuated within the first predetermined time, then the system proceeds to S604 wherein it determines whether or not the second flood detector 1*b* was actuated within the second predetermined time after the first flood detector 1*a* was actuated. If the determination result is affirmative, then the system decides that the fast flood speed applies, and proceeds to S608 wherein the system causes the elevator to stop at a nearest floor, then the system further proceeds to S609 wherein it causes the elevator to stop at a nearest floor and to open a door of the elevator then to close the door in a predetermined time before suspending the operation of the elevator. Thereafter, the system proceeds to S614 wherein the flood detection is displayed and reported at a car, a hall, or a personnel control board.

If the system finds that the second flood detector 1*b* was not actuated within the second predetermined time, then the system proceeds to S605 wherein it further determines whether or not the second flood detector 1*b* was actuated within the third predetermined time (e.g. 24 seconds) after the first flood detector 1*a* was actuated. If the determination result is affirmative, then the system decides that the standard flood speed applies, and proceeds to S610 wherein the system causes the elevator to travel until it stops at a first call during the travel if the elevator is in the middle of a car call or a hall call. After that, the system proceeds to S611 wherein, if the elevator stops at a first call, then all car calls and hall calls are cancelled, the door is closed in a predetermined time, and the operation is suspended. Subsequently, the system proceeds to S614 wherein the flood detection is displayed and reported at a car, a hall, or a personnel control board.

If the second flood detector 1*b* has not been actuated within the third predetermined time, then the system proceeds to S612 wherein it continues the operation. Thereafter, the system proceeds to S614 wherein the flood detection is displayed and reported at a car, a hall, or a personnel control board. The system returns to the beginning, and if it finds in S601 that the auxiliary flood detector 7 has been actuated, then it proceeds to S608 wherein the elevator is stopped at a nearest floor as previously mentioned.

As described above, according to the embodiment, when the pit of the elevator is flooded, the flood speed is detected and the flood control operation based on the flood speed is performed. This makes it possible to secure safety of passengers and to continue the operation of the elevator to almost a limit of allowable continued operation.

In the description, the two flood detectors are used for detecting a flood speed; however, three or more flood detectors may be used. Furthermore, the flood speed is detected by providing a plurality of flood detectors for different water levels. There are, however, diverse methods, including a method in which a flood weight is detected, and a method in which ultrasonic waves are applied to a pit and a water level is measured by a time required for the ultrasonic waves to reflect.

Furthermore, the four steps of flood control operation that are based on flood speed are described; however, five or more steps of control operation are also possible. In addition, the flood control operation is divided based on the flood speed. Alternatively, however, a time allowed for the elevator to run may be estimated based on a flood speed, and the operation may be performed based on a time allowed for safe operation.

Third Embodiment

Figure 7:
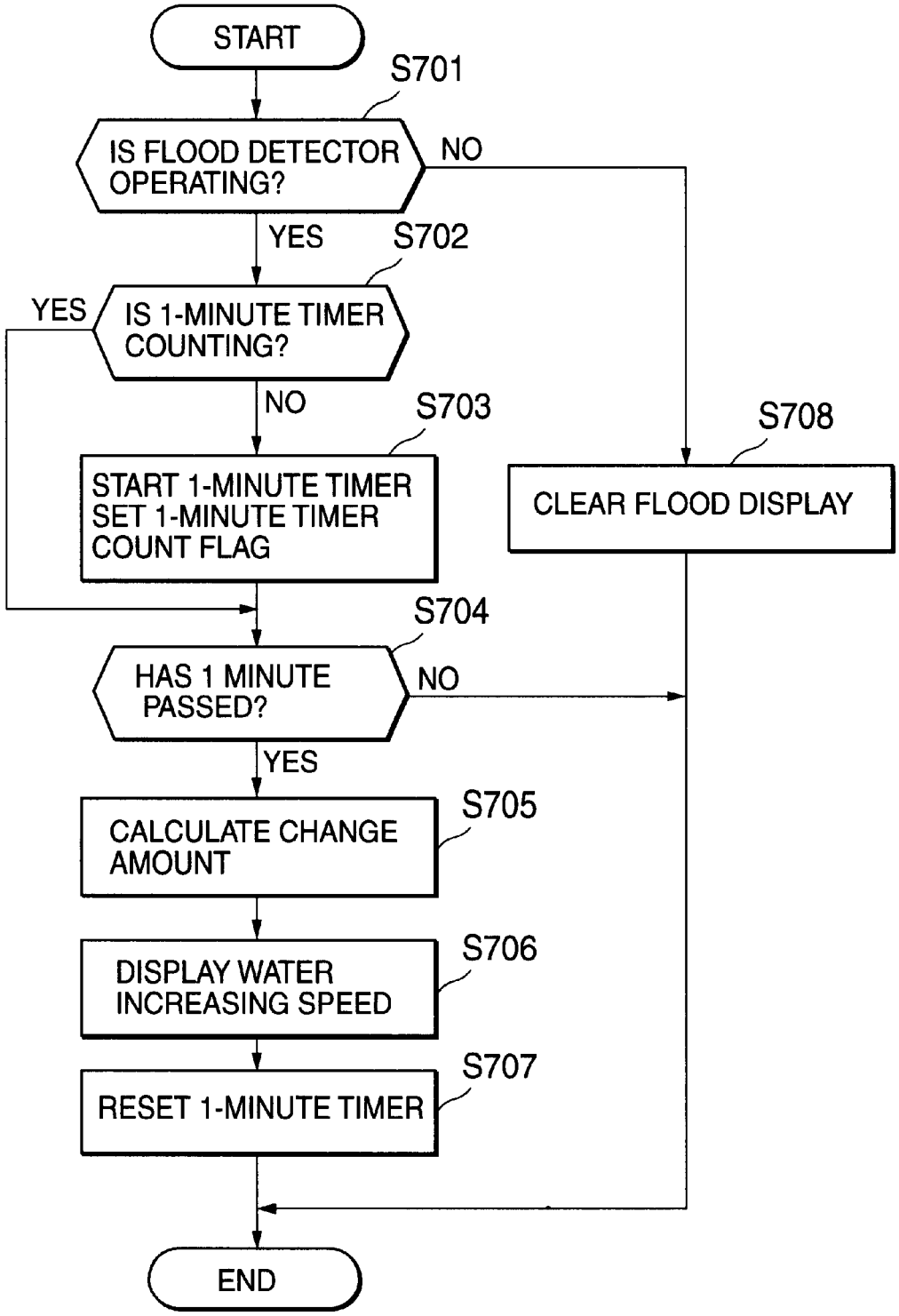
FIG. 7 is an operational explanatory diagram of a water increasing speed detecting program in an elevator control operation system according to a third embodiment of the present invention.
Figure 8:
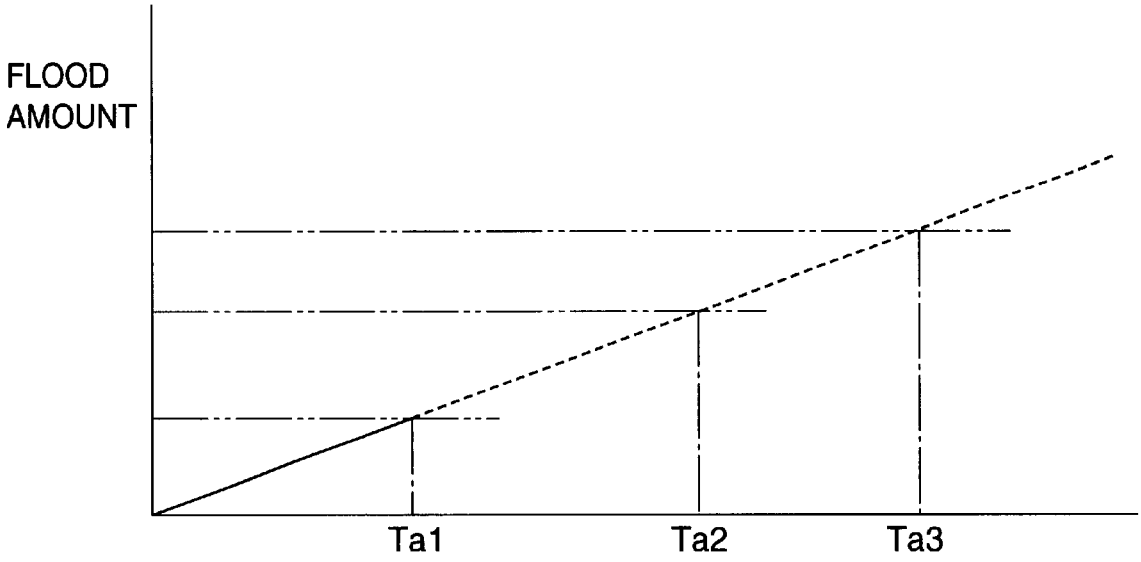
FIG. 8 is an explanatory diagram of flood speed.
Figure 9:
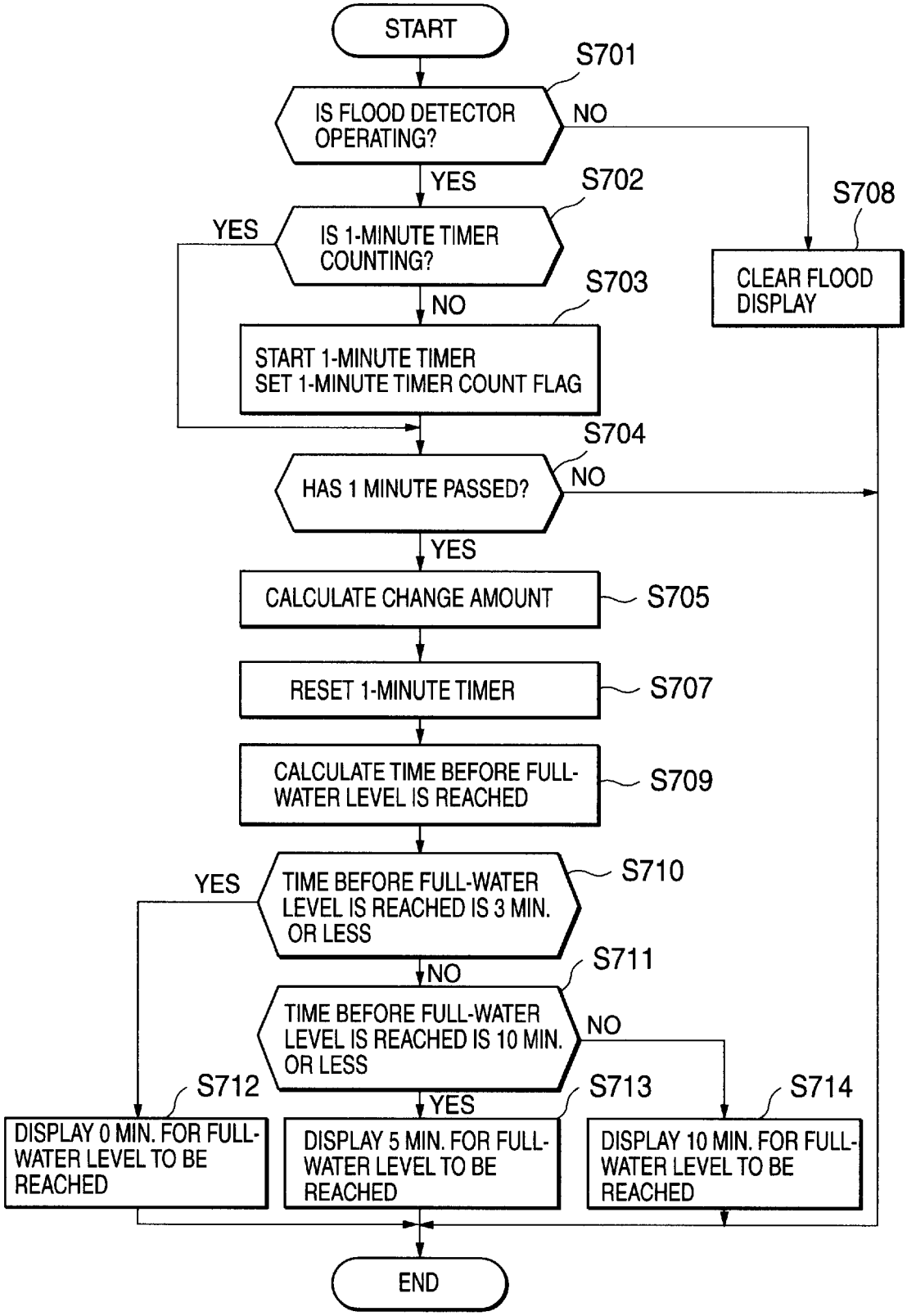
FIG. 9 is an operational explanatory diagram of a full-water estimation and detection program in the elevator control operation system according to a third embodiment of the present invention.
Figure 10:
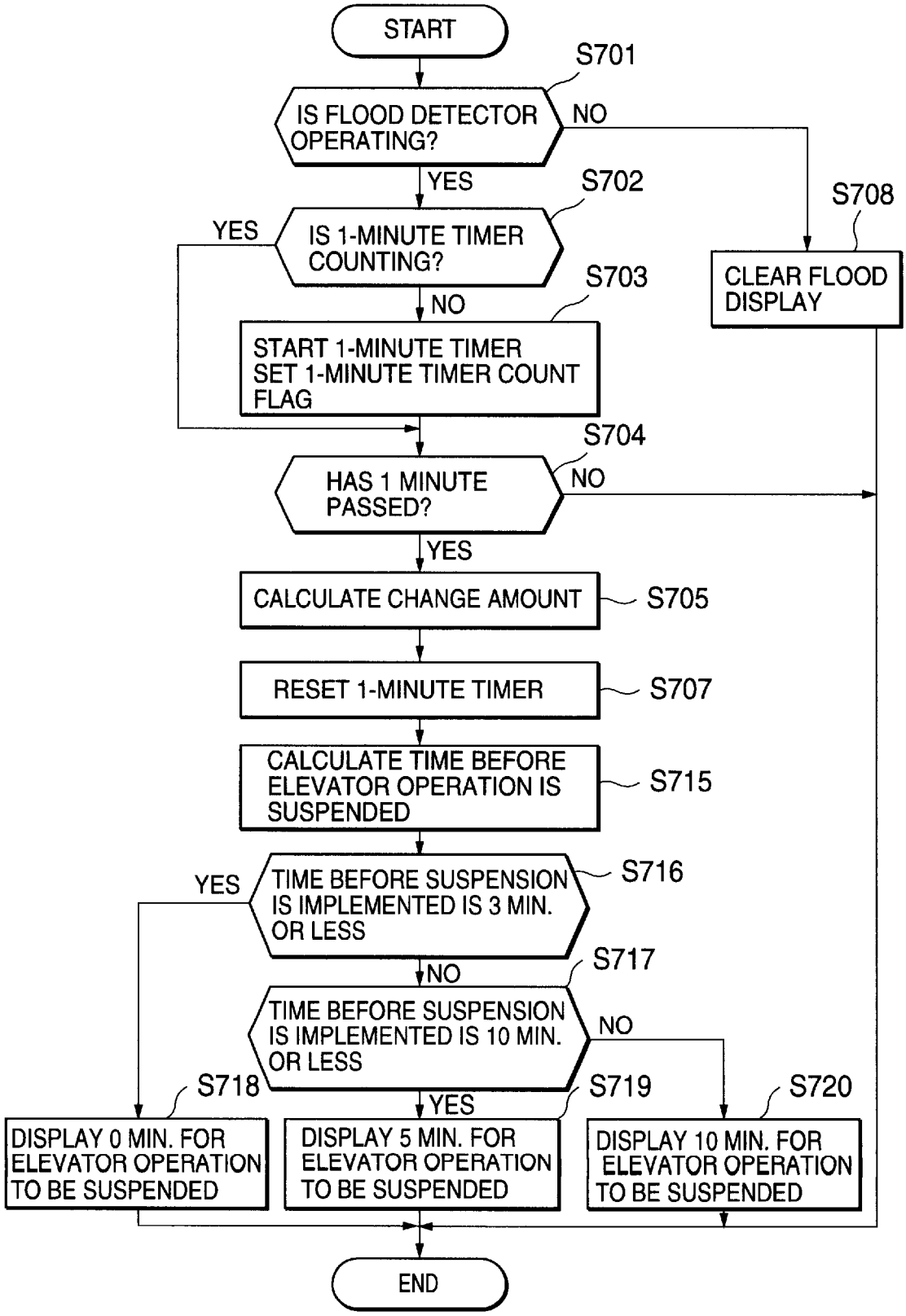
FIG. 10 is an operational explanatory diagram of a program of reporting an elevator use situation when water is increasing in the elevator control operation system according to a third embodiment of the present invention.
Figure 11:
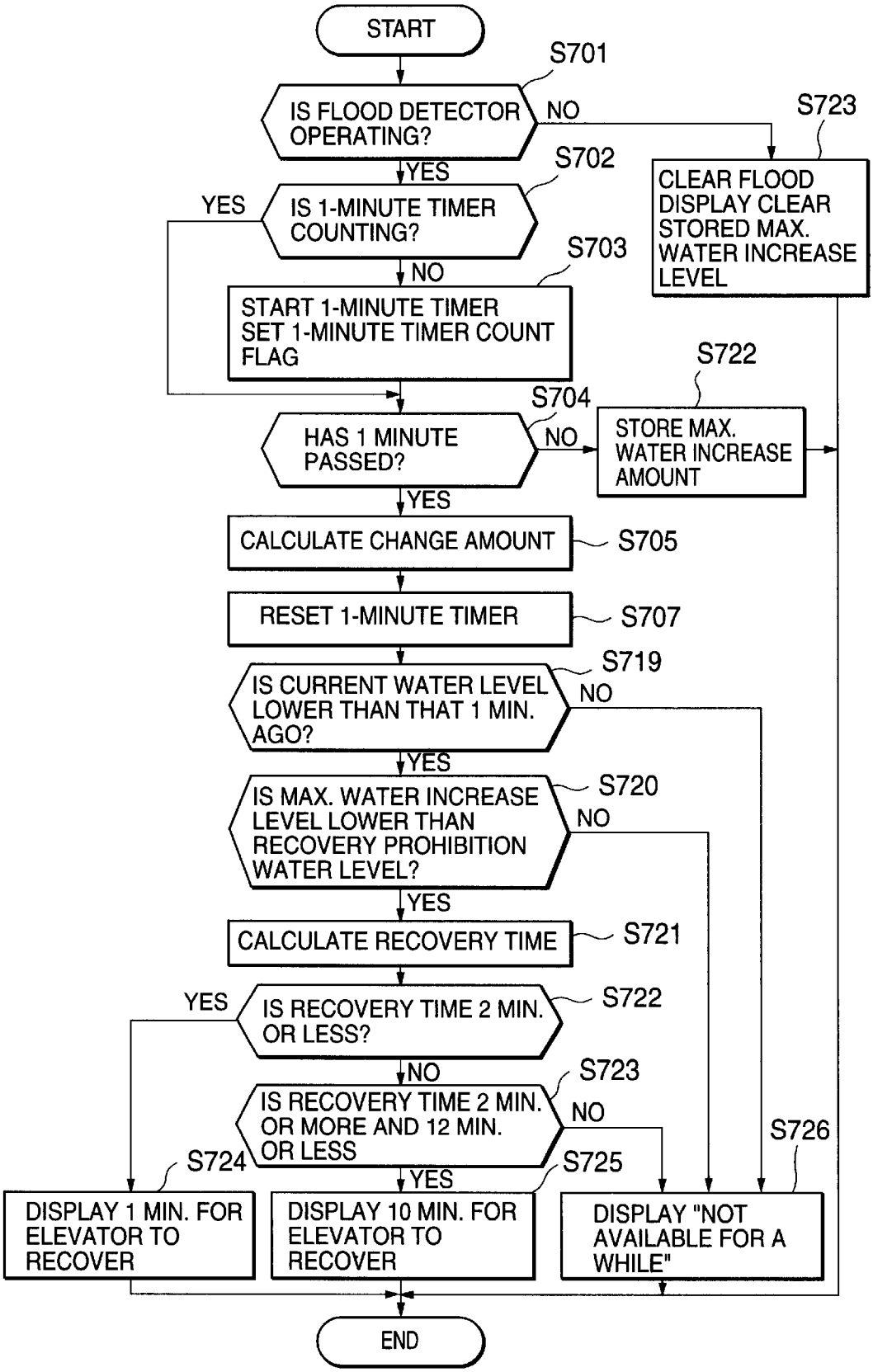
FIG. 11 is an operational explanatory diagram of a program of reporting an elevator use situation when water is decreasing in the elevator control operation system according to a third embodiment of the present invention.
Figure 12:
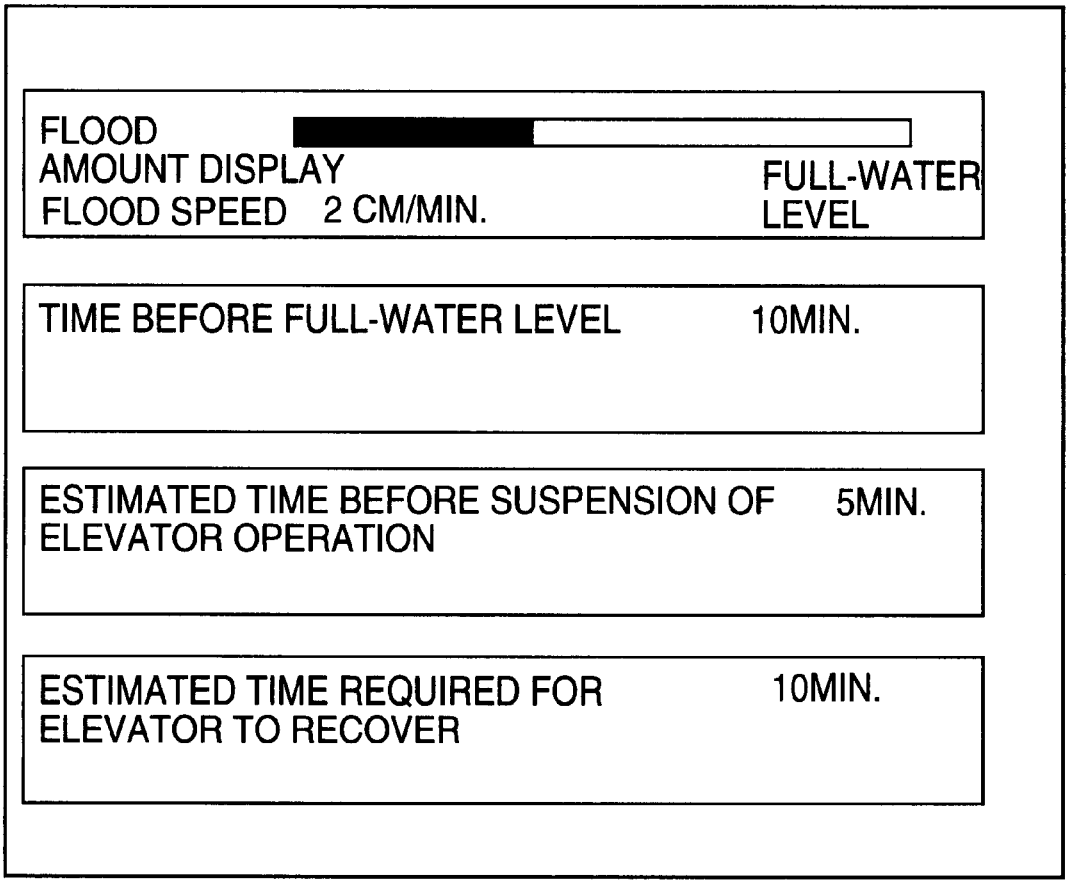
FIG. 12 is an example of display in case of a flood.

FIG. 7 is an operational explanatory diagram of a water increasing speed detection program. FIG. 8 is an explanatory diagram of flood speed. FIG. 9 is an operational explanatory diagram of full-water estimation and detection program. FIG. 10 is an operational explanatory diagram of a program for reporting an elevator use situation when water is increasing. FIG. 11 is an operational explanatory diagram of a program for reporting an elevator use situation when water is decreasing. FIG. 12 is an example of display in case of a flood.

The configuration of the elevator control operation system is basically the same as that shown in FIG. 1.

An operation for displaying flood speed in the elevator flood control operation system according to this embodiment will now be explained in conjunction with FIG. 7.

In S701, the system determines whether a flood detector 1 has been actuated or not, and if the determination result is affirmative, then the system proceeds to S702 wherein it determines whether a one-minute timer is counting or not. In an initial stage, the timer is not counting; therefore, the system proceeds to S703 wherein it starts the one-minute timer, and sets a one-minute timer counting flag. Subsequently, in S704, the system proceeds to END until the one minutes is counted. Thereafter, the system implements processing in an order of START→S701→S702→S704→END, and performs timer count.

Subsequently, when the system completes the one-minute count, it proceeds to S705 wherein it calculates an amount of increasing water. Based on the calculated amount, the system displays in S706 a water increasing speed on flood display units 6 installed in a hall, a car, a manager room, etc. Further, the system resets the one-minute timer in S707, and calculates and displays a water increasing speed again. An example of display is shown in FIG. 12. Furthermore, a full-water amount is detected based on method using weight or air.

An operation for estimating and detecting a full-water in an elevator flood control operation system according to this embodiment will now be described in conjunction with FIG. 8 and FIG. 9.

In FIG. 8, the abscissa indicates time, while the ordinance indicates changes in a flood amount.

An amount of change in time Ta1 since the flooddetector 1 was actuated is determined, and a water increasing time up to Ta1 is detected. Furthermore, based on the time Ta1, future water increasing times Ta2–Ta1 and Ta3–Ta1 are computed.

The operation for estimating and detecting full-water will now be described. From S701 through S705 and S707, an amount of change attributable to a flood from the moment the flood detector 1 was actuated is measured, in an order of START→S701→S702→S704→END, and in an order of START S701→S702→S705, S707 as in the case of FIG. 7. Based on the amount of change, a time for a full-water level to be reached is estimated as shown by the following formula in S709.

Full-water time=(Full-water amount−Current water level)/Amount of change

If the full-water level time is three minutes or less (S710), then the system displays on the flood display unit 6 installed in a car, a hall, a manager's room, etc. that the time for the full-water level to be reached is zero minute in S712. If the full-water level time is 3 minutes or more and 10 minutes or less (S711), then the system displays in S713 that a time for the full-water level to be reached is 5 minutes. If the full-water level time is 10 minutes or more, then the system displays in S714 that a time for the full-water level to be reached is 10 minutes. An example of display is shown in FIG. 12.

An operation of a program in the elevator flood control operation system according to this embodiment, which program is for reporting an elevator use state if water is increasing, will now be described in conjunction with FIG. 10.

The operation of the program for reporting an elevator use state if water is increasing will now be described. From S701 through S705 and S707, an amount of change attributable to a flood from the moment the flood detector 1 was actuated is measured, in an order of START→S701→S702→S704→END, and in an order of START→S701→S702→S705, S707 as in the case of FIG. 7. Based on the amount of change, a suspension time for the elevator to be shifted to a suspension mode is estimated as shown by the following formula in S715.

Suspension time=(Suspension water level−Current water level)/Amount of change

If the suspension time is three minutes or less in S716, then the system displays on the flood display unit 6 installed in a car, a hall, a manager room, etc. that the time before the elevator is suspended is zero minute in S718. If the suspension time is 3 minutes or more and 10 minutes or less (S717), then the system displays in S719 that a suspension time is 5 minutes. If the suspension time is 10 minutes or more, then the system displays in S720 that the suspension time is 10 minutes. A time before the elevator is brought to a suspension is announced by an announcing unit (not shown) installed in a hall, a car, a manager room, etc. An example of display is shown in FIG. 12.

An operation of a program in the elevator flood control operation system according to this embodiment, which program is for reporting an elevator use state if water is decreasing, will now be described in conjunction with FIG. 11.

The operation of the program for reporting an elevator use state if water is decreasing will now be described from S701 through S705 and S707, computation is performed in an order of START→S701→S702→S704→END, and in an order of START S701→S702→S705, S707 as in the case of FIG. 7 so as to constantly store a maximum water increasing amount since the flood detector 1 was actuated, in S722. In S719, the system compares a current water level with a water level observed one minute ago, and if an increase in water level is observed, then the system causes in S726 the flood display unit 6, which is installed at a hall, a car, a manager room, etc., to display a message saying "The elevator is riot available for a while". Furthermore, the system causes the announcing unit (not shown), which is installed in a hall, a car, a manager room, etc., to announce to that effect. If the water is decreasing, then the system compares, in step S720, the stored maximum water increase amount with a recovery prohibition water level. If the maximum water increase amount is larger than the recovery prohibition water level, then the system performs the same processing as the one described above in S726. If the maximum water increase amount is smaller than the recovery prohibition water level, then the system proceeds to S721 wherein it calculates a recovery time according to a formula shown below:

Recovery time=(Current water level−Recovery prohibition water level)/Amount of change In S722, if the recovery time is 2 minutes or less, then the system causes the flood display unit 6 to display that the time required for recovery is 1 minute and causes the announcing unit to announce to that effect in S724. If the recovery time is 2 minutes or more, then the system proceeds to S723. If the recovery time is 12 minutes or more, then the system performs the same processing as the one described above in S726. If the recovery time is 12 minutes or less, then the system causes the flood display unit 6 to display that the recovery time is 10 minutes and causes the announcing unit to announce to that effect in S725. An example of display is shown in FIG. 12.

The detection of a flood amount is performed based on method using weight or air; however, the detection method is not limited thereto. In the above description, the flood information has been displayed at a car, a hall, and a manager room; the information can be easily given to a security company also. The time required for the elevator to become available again has been determined based on a maximum water increase amount; maintenance time or the like may be added to the time and display the resultant time.

An example of a display method is shown in FIG. 12. The display method, however, is not limited thereto; display may be a combination of LED display or the like.

Thus, according to the embodiments, if a pit of an elevator is flooded, a flood amount and a flood speed are displayed, and a future flood state is predicted to carry out control for display and announcement. This allows a manager to take action against the flood, such as bringing the elevator to a predetermined position beforehand or draining water from the pit, and also makes it possible to secure safety of passengers.

Moreover, users of an elevator will be also informed, in advance, that the elevator will be unavailable because of a flood. In addition, when the elevator is recoverable, the users will be also informed of a time when the elevator will be available again, thus achieving a more user-friendly elevator.

INDUSTRIAL APPLICABILITY

As described above, the present invention relates to a control operation system for an elevator that detects a flood in a pit of an elevator, carries out operation control against the flood, and provides display and information regarding the flood.

What is claimed is:

1. A control operation system for an elevator comprising:

a flood detector for detecting a flood amount in a hoistway in an elevator;

flood speed computing means for computing a flood speed based on the flood amount detected by the flood detector; and flood control operation command means for setting a flood control operation for the elevator based on the flood speed computed by the flood speed computing means, and issuing a command to an elevator.

2. The control operation system for an elevator according to claim 1, further comprising flood predicting means for predicting a future flood development based on at least one of the flood amount detected by the flood detector and the flood speed computed by the flood speed computing means, wherein the flood control operation command means sets a flood control operation based on the future flood development predicted by the flood predicting means.

3. The control operation system for an elevator according to claim 2, further comprising:

display information generating means for editing at least one of the flood amount detected by the flood detector, the flood speed computed by the flood speed computing means, and the future flood development predicted by the flood predicting means into a display format; and a flood display unit for displaying information edited by the display information generating means.

4. The control operation system for an elevator according to claim 3, wherein the flood display unit displays an estimated time for flood amount to reach a threshold water level after a flood in the hoistway is detected.

5. The control operation system for an elevator according to claim 1, wherein, if a flood in the hoistway reaches a threshold water level at at least a first speed, the flood control operation command means causes the elevator to immediately stop.

6. The control operation system for an elevator according to claim 5, wherein, if the flood in the hoistway reaches the threshold water level slower than the first speed but at least as fast as a second speed, the flood control operation command means causes the elevator to stop at the nearest floor.

7. The control operation system for an elevator according to claim 6, wherein, if the flood in the hoistway reaches the threshold water level slower than the second speed, the flood control operation command means prevents a new call from being assigned to the elevator, and causes the elevator to stop at a nearest evacuation floor after responding to at least one call that has already been assigned.

8. The control operation system for an elevator according to claim 1, wherein if the flood detector detects a flood amount in the hoistway, the flood control operation command means prevents response to a floor proximate a terminal.

9. The control operation system for an elevator according to claim 1, further comprising an auxiliary flood detector for detecting at least a water level in a range that should be detected by the flood detector, wherein if the flood detector is not actuated at a water level that should be detected by the flood detector, while the auxiliary detector is actuated, the flood control operation command means causes the elevator to stop at a nearest evacuation floor.

10. The control operation system for an elevator according to claim 3, wherein if a flood amount in the hoistway declines without reaching a threshold water level, then the flood predicting means estimates a recovery time required for reaching a water level that permits elevator operation to be resumed, and the flood display unit displays the recovery time estimated.

11. The control operation system for an elevator according to claim 10, wherein, when the flood amount in the hoistway reaches the water level that permits elevator the operation to be resumed, the flood control operation command means clears a flood control operation mode and restores a normal operation mode.

12. The control operation system for an elevator according to claim 1, wherein once the flood amount in the hoistway has reached a threshold water level, flood control operation is continued even when water level decreases.

13. The control operation system for an elevator according to claim 12, further comprising a reset switch, wherein, if the flood control operation continues the reset switch is operated to clear a command for the flood control operation.

* * * * *